United States Patent [19]

Fanshawe et al.

[11] Patent Number: 4,705,082

[45] Date of Patent: Nov. 10, 1987

[54] METHOD OF AND APPARATUS FOR FILLING A CONTAINER WITH GAS

[76] Inventors: Hew D. Fanshawe, The Elms, Broad Street, Bampton, Oxfordshire OX8 2LS; John K. Conway, 22 Queensway, Sawston, Cambridge CB2 4DJ, both of England

[21] Appl. No.: 756,500

[22] Filed: Jun. 26, 1985

[30] Foreign Application Priority Data

| | | | |
|---|---|---|---|
| Nov. 16, 1983 | [GB] | United Kingdom | 8330532 |
| Nov. 29, 1983 | [GB] | United Kingdom | 8331869 |
| Jul. 18, 1984 | [GB] | United Kingdom | 8418255 |
| Nov. 12, 1984 | [WO] | PCT Int'l Appl. | PCT/GB84/00390 |

[51] Int. Cl.[4] ..... B65B 31/00

[52] U.S. Cl. ..... 141/4; 141/82

[58] Field of Search ..... 141/4, 82

[56] References Cited

U.S. PATENT DOCUMENTS

| | | | |
|---|---|---|---|
| 1,339,431 | 5/1920 | Backhaus | 141/4 |
| 4,351,372 | 9/1982 | Delgado, Jr. | 141/2 |
| 4,527,600 | 7/1985 | Fisher et al. | 141/4 |

FOREIGN PATENT DOCUMENTS

| | | |
|---|---|---|
| 1136356 | 9/1962 | Fed. Rep. of Germany . |
| 1501735 | 1/1970 | Fed. Rep. of Germany . |
| 2603664 | 8/1977 | Fed. Rep. of Germany . |
| 1587090 | 5/1978 | United Kingdom . |
| 2127533 | 9/1983 | United Kingdom . |

OTHER PUBLICATIONS

Chemical Abstracts, vol. 91, p. 283, item 145331.

*Primary Examiner*—Stephen Marcus
*Assistant Examiner*—Mark Thronson
*Attorney, Agent, or Firm*—Christie, Parker & Hale

[57] ABSTRACT

A pump (18) draws liquefied carbon-dioxide from a reservoir (4 or 6) and delivers it via a controllable heater (20) and a filling valve (14) to a cylinder (26) to be filled to any required density. This receiver cylinder (26) is controllably warmed by a heater (32) while sensors (22,24) are provided to indicate the pressure and temperature of its contents.

For each required density a table of figures is provided relating pressures (above saturation pressure) to temperature, for that density.

A temperature (which must be clear above the lowest temperature at which the receiver will be liquid-fill at the required density but which need not exceed the critical temperature) is selected, and the heaters (20 and 32) are controlled so that the receiver cylinder and its contents will converge at or near that temperature as filling is completed.

During the final phase of filling the indicated temperature will rise slowly and the pressure (from the time the receiver is liquid-full) will rise relatively fast.

At the time temperature and pressure match a pair of figures on the table provided, the filling valve (14) is closed cutting off the supply of gas at the fill density required.

2 Claims, 5 Drawing Figures

TABLE

| MAXIMUM FILL DENSITY 750 g/litre (safe limit) Target Density 720 g/litre | |
|---|---|
| °C Fill Temperature | (bar) Int. Cyl. Pressure |
| 24 | * |
| 26 | 71 |
| 28 | 77 |
| 30 | 83 |
| 32 | 90 |
| 34 | 97 |
| 36 | 104 |
| 38 | 112 |
| 40 | 119 |

* Liquid + vapour at this temperature, being below saturation line

FIG. 5

METHOD OF AND APPARATUS FOR FILLING A CONTAINER WITH GAS

The present invention relates to a method of and apparatus for filling a container with a liquefiable gas to a predetermined density within acceptable limits of accuracy.

In the context of gas cylinders and containers and their filling, gases have been classified according to their Critical Temperatures ($T_c$) (1968 Home Office Report and relevant British Standards).

The Critical Temperature ($T_c$) of a gas is the highest temperature at which a gas can be liquified by subjecting it to pressure. Above this temperature, increasing the pressure compresses the gas so that its characteristics change progressively towards those associated with liquids, though preserving an elasticity not commonly found in liquids. Those gases for which $T_c$ is less than minus 10° C., so which cannot coexist as vapour and liquid together whatever the pressure, if at "normal" or higher temperatures, are classified as Permanent Gases.

Those gases for which $T_c$ lies between minus 10° C. and 70° C. are classified as High Pressure Liquifiable Gases, while those with $T_c$ greater than 70° C. are classified as Low Pressure Liquifiable Gases.

The critical pressure ($P_c$) of a gas is the pressure which is just sufficient to liquefy the gas as the critical temperature $T_c$.

The critical density ($D_c$) of a gas is the density of the gas when at this CRITICAL POINT.

The present invention concerns High Pressure Liquefiable Gases, and particularly gases for which $T_c$ lies between 20° C. and 40° C., and very particularly for carbon-dioxide for which $T_c$ is close to 31.1° C.

It will be appreciated that when a liquefiable gas is above $T_c$ it has the characteristics associated with Permanent Gases, being a single-phase gaseous fluid which will not condense to liquid under increasing pressure.

To avoid ambiguity, since the word gas is commonly used for normally gaseous elements and compounds in liquid, solid or mixed forms as well as when gaseous, the spelling GASS is used herein to describe the phase state of a gas when above its critical temperature, yet not under such extreme pressure (measured in thousands of bars) that it begins to solidify.

At temperatures below $T_c$, gases can exist in various states: as vapour alone, as part vapour and part liquid, as liquid alone, and as solid too.

FIG. 2 of the accompanying drawings shows a simple phase diagram for carbon-dioxide ($CO_2$) on axes of temperature and entropy. The phases are named, in the area of practical interest.

The critical temperature is shown dotted, to indicate that there is no phase change involved in moving between the state named dry vapour to that named GASS herein—(and commonly called gas in this context)—and from GASS to compressed liquid.

As illustrated more clearly in FIG. 3, the critical point $C_p$ is that point at which the 470 grams per liter density line (not shown) intersects the horizontal line of critical temperature 31.1° C.

For all the important commercial gases, the relations between pressure, temperature, density, entropy and enthalpy are known in detail for all but extreme temperatures and pressures, and data are available in tabular form, or on elaborate temperature-entropy diagrams for each particular gas with curves of constant pressure, density, enthalpy and other characteristics added to the simple phase diagram of which FIG. 2 herein is an example.

The refilling of gas cylinders with liquefiable gases such as carbon dioxide ($CO_2$) is a demanding process. When filling cylinders with gas, care must be taken to ensure that the quantity of gas put into the cylinder exceeds a set minimum quantity (which quantity, may be the quantity marked on the cylinder for commercial purposes). However particular care must also be taken not to exceed the maximum safe fill, normally defined by standards or regulations (taking account of the strength of the cylinder being filled) as a maximum mass per unit volume of capacity.

In the United Kingdom the present specified maximum is normally 750 grams per liter of $CO_2$, which is a density, though at normal filling temperatures this will be represented by part liquid part vapour, so the term average density may be more appropriate.

When vapour and liquid are both present in the cylinder being filled (the "receiver"), the pressure in that receiver depends only upon its temperature. When filling, from the time that there is enough gas for liquid to being to condense to the time the receiver is full, the pressure will change only if the temperature changes. Accordingly, pressure is no guide to the level of fill, and it is the customary practice to measure the volumetric capacity of the cylinder, to calculate the maximum mass permissible from the specified maximum density, and to establish the safe maximum weight for the filled cylinder by adding the empty weight of the complete cylinder also previously measured and usually marked on the cylinder. This maximum weight is then used as the criterion for the maximum fill.

Thus it is the customary practice to fill $CO_2$ and similar liquefiable gases by a weighing technique.

Typically, the maximum filled weight is marked on the cylinder to be filled, or the empty weight and volumetric capacity are marked, so a target weight for filling, safely inside the maximum, can be preselected.

The cylinder is coupled to a supply of $CO_2$ and placed on a weighing machine, and its increasing weight monitored during filling, until it approaches the maximum weight, when the supply is disconnected.

Accuracy is lost due to the need for coupling the supply to the cylinder on the machine, that part of the weight of the coupling which adds to the weight measured and the weight of the gas or liquid within it, being difficult to determine.

More important is the liability to error in the processes of reading figures, of calculation when needed, and of correctly matching target and observed weights.

Since overfilling can prejudice the safety of the cylinder, this process requires special care and the use of skilled staff.

The invention therefore seeks to provide an improved method of and apparatus for filling a container with liquefiable gas.

The invention also seeks to provide a method of and apparatus for filling a container with gas to a predetermined desired density, whose use does not require knowledge of the volumetric capacity of the container, and does not require recourse either to weighing or to volumetric measurement of the gas being filled, and yet presents no absolute need for the container and its contents to be at a temperature above the CRITICAL TEMPERATURE of the gas being filled, though using the method it may often be convenient that they should be so. If the fuel container is filled with $CO_2$ it then need not be noticeably warm.

According to one aspect of the invention there is provided a method of filling a container with high pressure liquifiable gas to a preselected density above the critical density comprising the steps of:

(a) establishing, for the particular gas to be filled and for the maximum safe limit of filling density a suitable lower target density and that set of pressures each of which characteristically corresponds to a unique temperature higher than or equal to the saturation temperature for that density;

(b) registering this 1-to-1 relationship between the pressure and temperature in a suitable form to be available for reference, or for comparison with indicated pressures or indicated temperatures;

(c) supplying the gas to the container;

(d) controllably heating the container or the gas being supplied to the container or both to a temperature such that the contents of the container, when the preselected density has been reached, are in compressed liquid or GASS phase:

(e) discontinuing the supply of gas as the pressure in the container attains the registered pressure level corresponding to the measured temperature of the gas in the container.

If appropriate, pressures and temperatures may be monitored continuously.

According to a second aspect of the invention there is provided gas filling apparatus, comprising a reservoir of gas, means for inducing a flow of gas from the reservoir, coupling means for receiving a container to be filled with gas incorporating a gas cock and providing communication between the container and the flow inducing means, and heating means for heating the gas being pumped to the container and/or for heating the container when coupled to the coupling means to such an extent that the temperature of the contents of the container when filled to the preselected density is above the lowest temperature at which the particular gas being filled is in the compressed liquid phase, and pressure and temperature sensing means for sensing the pressure and temperature of gas within the container, said lowest temperature being that temperature above which all the gas in the container is in a single phase state whereby the pressure measurement is directly indicative of the density of gas in the container.

According to a third aspect of the invention there is provided a method of filling a container with high pressure liquefiable gas to a preselected density wherein the pressure and/or temperature of the gas is controlled such that it is always within the compressed liquid single phase region of the property chart for that substance and at temperatures in the region near-above, at or below the critical temperature for that substance.

Also that the departures will arise due to various sources of inaccuracy which will include: imperfections in the data provided by the tables of pressure and temperature, small differences between the pressure and temperature to which the sensors are exposed and those representative of the thermodynamic state of the cylinder contents, and imperfections in the data output of the sensors themselves and in the precise timing of the closure of the filling valve.

Accordingly, acceptability can be achieved by reducing these sources of inaccuracy by careful design of and selection of component parts for the apparatus, so that their total effect keeps the actual fill within the limits described. Alternatively, the minimum quantity representing the lower limit of density can be reduced to increase room for inaccuracy; however, the wide limits of current commercial practice are likely to be more than sufficient, so allowing the present invention to reap further advantage.

Apparatus for and a method of filling a gas cylinder with carbon dioxide and embodying the invention will now be described, by way of example, with reference to the accompanying diagrammatic drawings, in which:

FIG. 5 is a table of temperature of a $CO_2$ fill versus density of $CO_2$ in a container being filled, for a preselected density less than the maximum safe density.

Figure 1:
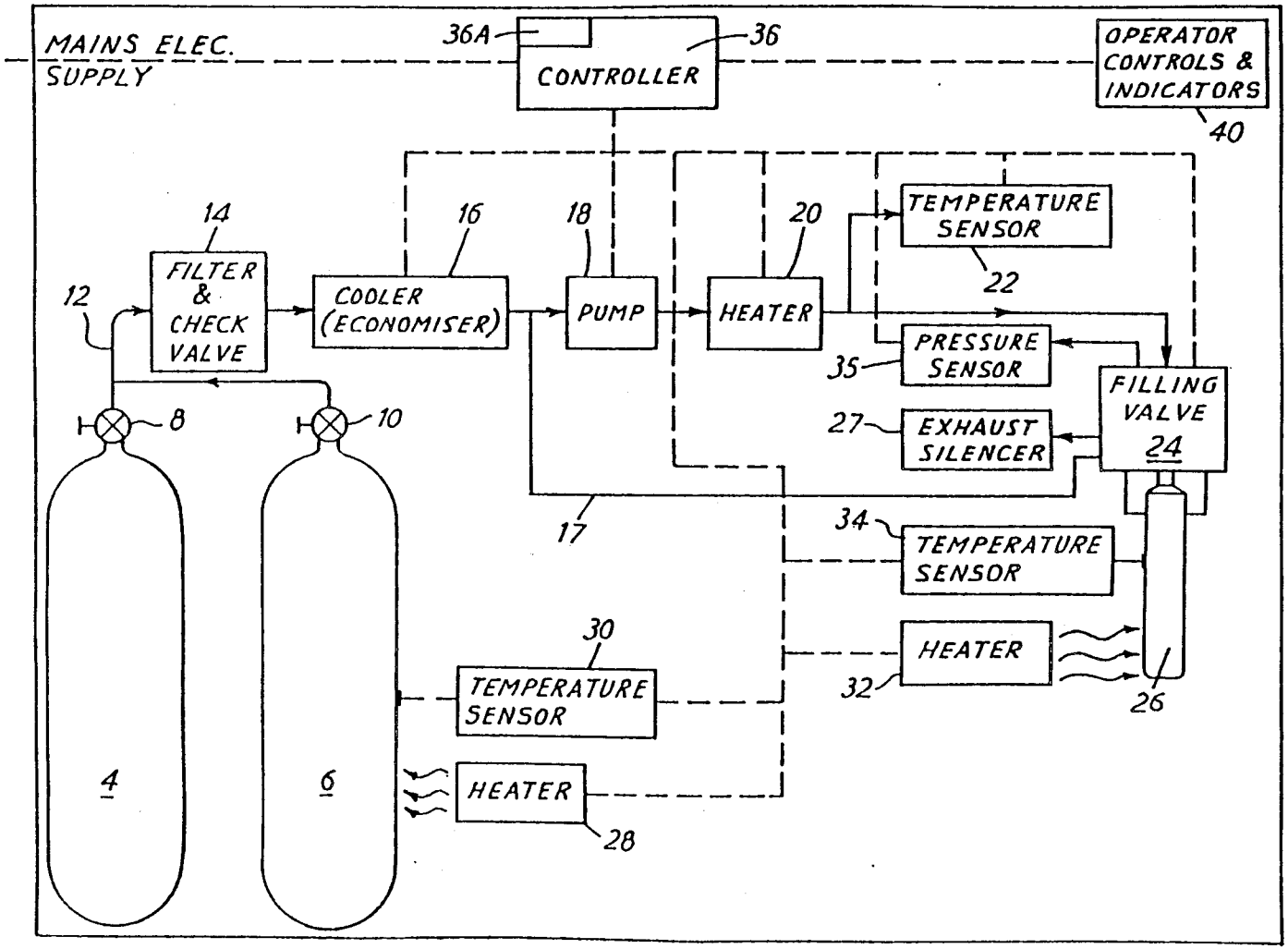
FIG. 1 is a block diagram of the apparatus.

As shown in FIG. 1 a pair of gas reservoirs 4 and 6 supply carbon dioxide gas through respective valves 8 and 10 to a common supply line 12. The supply line is connected to a filling valve 24 through a filter and check valve 14, an optional cooler 16, a pump 18 and a heater 20. A temperature sensor 22 senses the temperature and a pressure sensor 35 senses the pressure of gas supplied to the filling valve 24. An optional exhaust silencer 27 is coupled to an exhaust vent (not shown) of the filling valve 24. An optional recirculation line 17 connects the filling valve 24 back to the pump 18.

A cylinder 26 to be filled with gas is coupled to the filling valve 24 and a heater 32 is positioned to supply heat to the cylinder 26. A temperature sensor 34 monitors the temperature of the cylinder 26.

A heater 28 may also be provided to supply heat to the reservoir 6 and a temperature sensor 30 may be provided to monitor the temperature of the reservoir 6. A similar heater and temperature sensor (not shown) may be provided for the reservoir 4.

A controller 36 is connected to the cooler 16, the pump 18, the heaters 28, 32 and 20, the filling valve 24, the pressure sensor 35 and the temperature sensors 22, 30 and 34.

A panel 40 supports the operator controls in the form of pressure and heat control dials (not shown).

The panel 40 also includes pressure and temperature indicators providing visual or other indications of the pressure and temperature sensed by the temperature and pressure sensors 34, 35.

Tables of temperatures and complementary pressures corresponding to the target densities preselected for each of the normally limited number of maximum safe filling densities for each type of gas to be filled are also provided. FIG. 5 shows one such table for the gas $CO_2$. The tables should be in a form suitable for comparison with indications from the sensors.

In operation a cylinder 26 to be filled with (say) $CO_2$ is coupled to the filling valve in the form of a gas cock 24, and one of the control valves 8 or 10 is opened. A heat control dial (not shown) on the panel 40 is set to a temperature of say 30° C. and a start control on the panel 40 is actuated. The controller 36 responds by energising the three heaters 20, 32 and (if fitted) 28 to heat the common supply line 12, the cylinder 26 to be filled and (if heater 28 fitted) the reservoir 6.

The controller responds to sensor 22 (mounted at the outlet from heater 20) to control heater 20 to maintain the $CO_2$ supply at not less that 30° C., and responds to sensor 34 to control heater 32 so the cylinder 26 and its contents reach a temperature near 30° C. as filling nears completion. The controller may also respond, when heater 28 is fitted, to temperature sensor 30, controlling the heater 28 to raise to and maintain the cylinder 6 at a suitable temperature, say 20° C.

As soon as the sensor 22 indicates that 30° C. has first been reached the controller 36 acts to energise the pump 18 and so gas is pumpted through the heater 20 and filling valve 24 to the cylinder 26.

The pressure and temperature within the cylinder 26 sensed by the sensors 35 and 22, are monitored on the panel and compared by the operator with the selected table of pressures versus temperatures for $CO_2$ at the desired density.

As filling proceeds the temperature will rise relatively slowly so that the complementary pressure for the preselected density can be followed on the table. When pressure indicated by sensor 35 and monitored on the panel 40 is seen by the operator to match the tabled pressure indicating the desired density, he closes/trips the actuator of the filling valve 24 to cut off the supply of gas to the cylinder 26, which action causes the controller to stop the pump 18 and to deenergise heaters 32 and (as appropriate) heaters 20 and 28. Alternatively, instead of stopping the pump 18 the supply of gas is recirculated through the optional line 17 to the inlet of the pump 18. At this point the cylinder will be full to the preselected density of gas, within acceptably close limits. The controller finally opens the exhaust vent coupled to the exhaust silencer 27, to empty $CO_2$ from the coupling so to facilitate disconnection of the now filled receiver.

The controller 36 in a modified form includes a comparator 36A for automatically comparing data representing the pressure level corresponding to the preselected density of gas (when in compressed liquid or GASS phase) at a temperature currently indicated by the temperature sensor with the actual pressure sensed in the container. The comparator acts in response thereto to trip the actuator of the filling valve and control the supply to and disconnection of the heater 32 and the pump 18 in a sense to produce the preselected density of gas in the container after disconnection.

Figure 3:
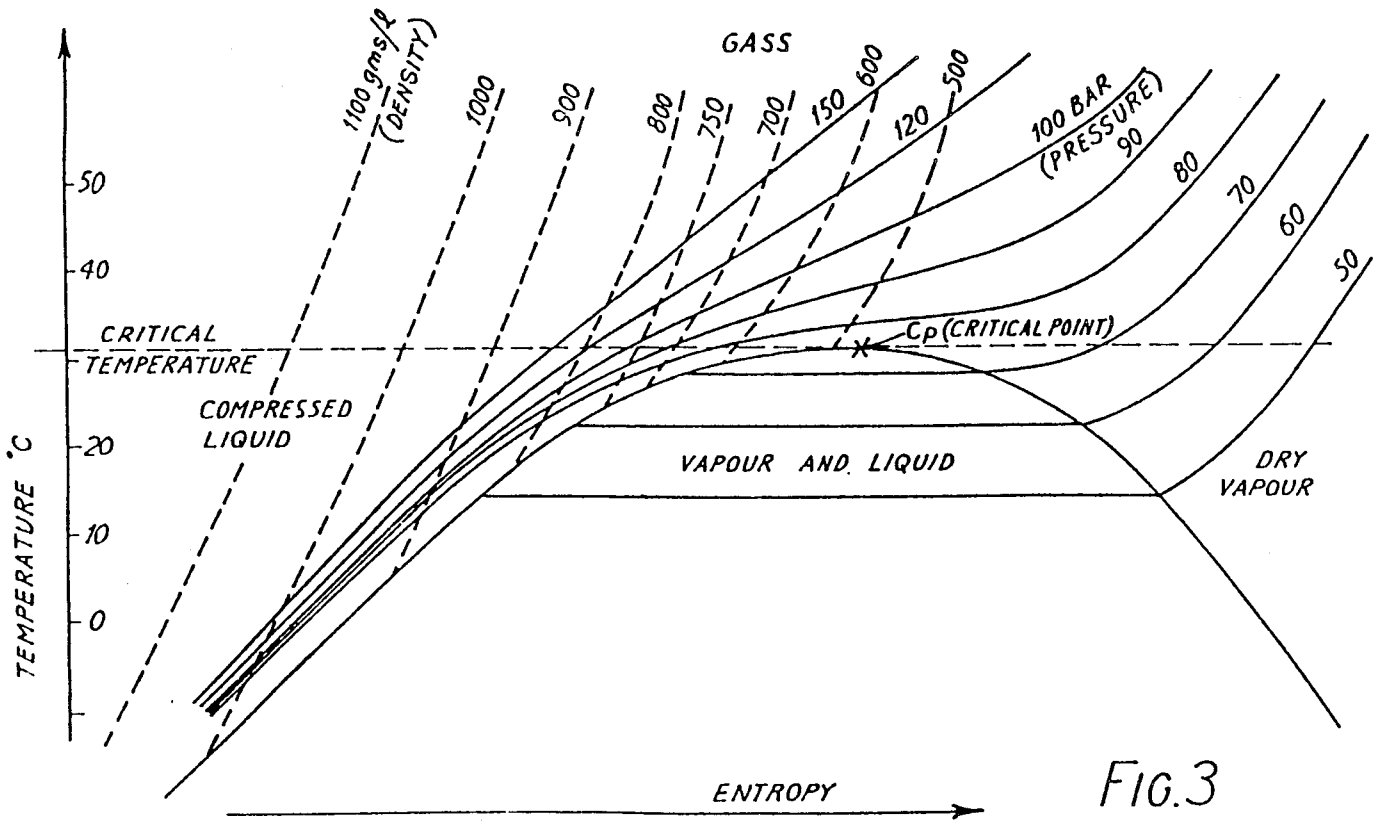
FIG. 3 is a graph to an enlarged scale showing Temperature versus Entropy and illustrating lines of equal pressure and density.

The density target pre-selected for the gas in the container will normally far exceed the critical density. For commercial reasons, and to assist clarity the description herein is in terms appropriate to densities above CRITICAL DENSITY (the equivalent method for sub critical target densities will be apparent). FIG. 3 illustrates more clearly the relation of pressures and temperatures for those densities which are greater than the critical density. FIG. 3 also shows the juxtaposition of liquid and GASS phases and illustrates how packing of $CO_2$ into a container, in a single phase condition, at temperatures below the critical temperatures is possible if temperature is appropriately controlled.

In practice, when filling a container with $CO_2$ a fill density of (for instance 730 gram per liter) would be preselected in order to achieve a safe underfill not exceeding a maximum of 750 grams per liter.

It will be appreciated that the actual fill achieved may be established to any desired degree of accuracy by careful weighings, and any systematic departure from preselected fill observed may be used in calibrating the apparatus to improve its precision.

It will be appreciated that the maximum safe density of fill defined by regulation, and the minimum fill which, for commercial reasons, is required to be achieved together define a range in which the target density must be preselected, so that maximum departure from this preselected density will keep the actual fill within the range defined.

When filling the container, a target temperature is selected for the contents of the container. The heating of the container and/or the gas supplied to the container is controlled so that the contents of the container are close to the target temperature at the time when filling is complete. The target temperature is selected to be around the critical temperature of the $CO_2$ but positively above the liquid saturation temperature of the $CO_2$ at the preselected density. Preferably the target temperature should not exceed 37° C. or blood heat.

Advantageously, the target temperature of the cylinder is selected either in the range of from 20° C. to 31.1° C., otherwise in the range in excess of 31.1° C.

Figure 4:
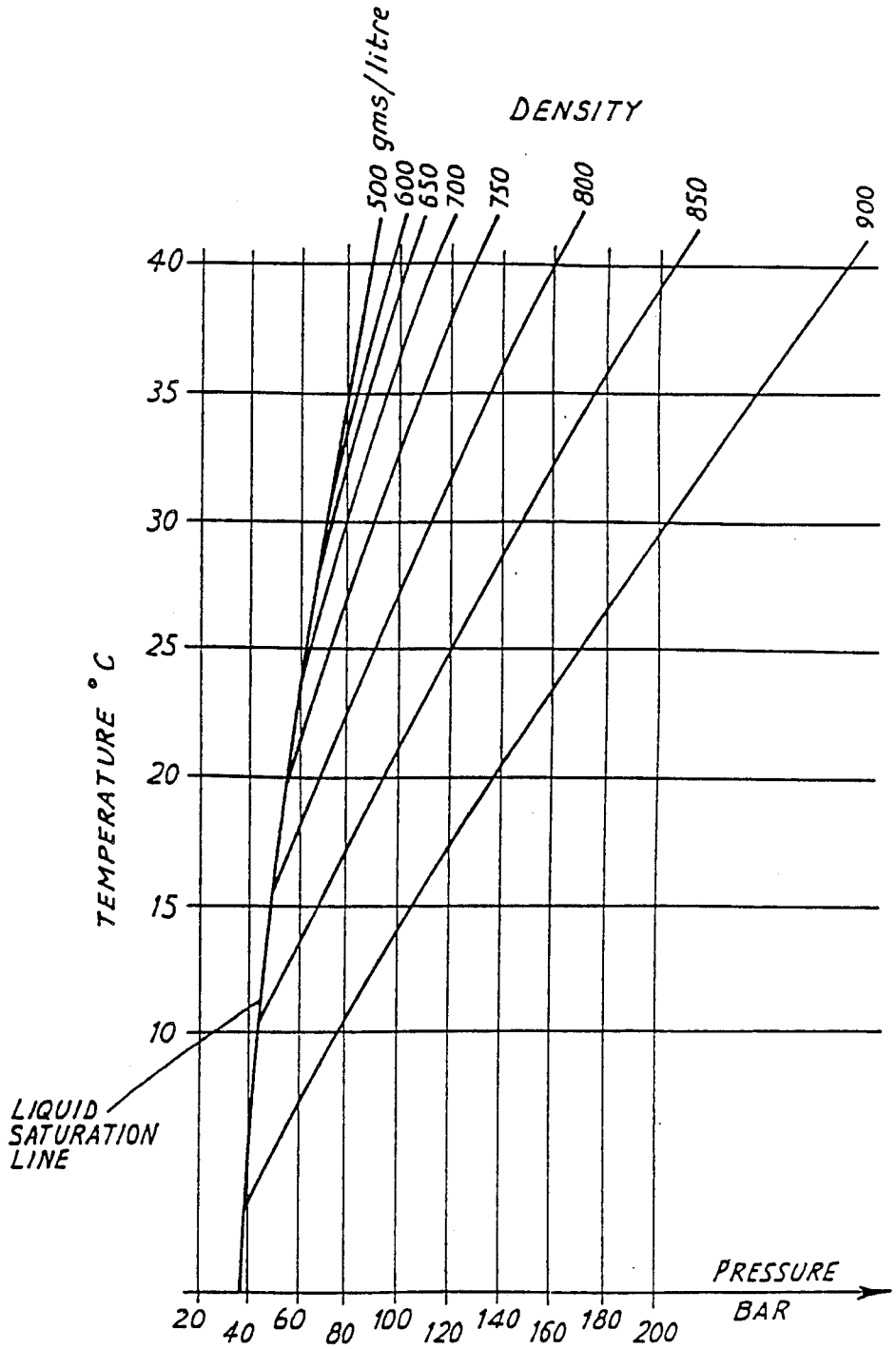
FIG. 4 is a graph of Temperature versus Pressure for $CO_2$ illustrating lines of equal density.

FIG. 4 is a graph of temperature versus pressure for liquefied $CO_2$ and shows curves for various densities. As can be seen, the 0.5, 0.6 and 0.7 density curves all merge in joining the liquid saturation line at temperatures above 20° C. and so the Figure illustrates why packing $CO_2$ at these densities and temperatures below 20° C. is not possible without weighing.

FIG. 4 is useful in as much as it relates density of fill to the parameters being controlled; that is temperature and pressure.

It will further be appreciated that most of the functions ascribed above to the operator are entirely suitable to be incorporated in the apparatus, particularly the comparison of monitored data with data from (what would become) a set in an internal store of such data sets, and the instant initiation of the sequence of operations when the appropriate data match is achieved. The operator must, of course, initially register on the controller the gas selected when the supply reservoir is installed, and register the desired density of fill and perhaps also register the selected nominal temperature defining the temperature range in which the fill is to be completed (though this may well be automatically selected when registering the gas and the density to be filled). He must also reset these should the desired filling density or duty change, but in commercial practice this will not often be required.

Figure 2:
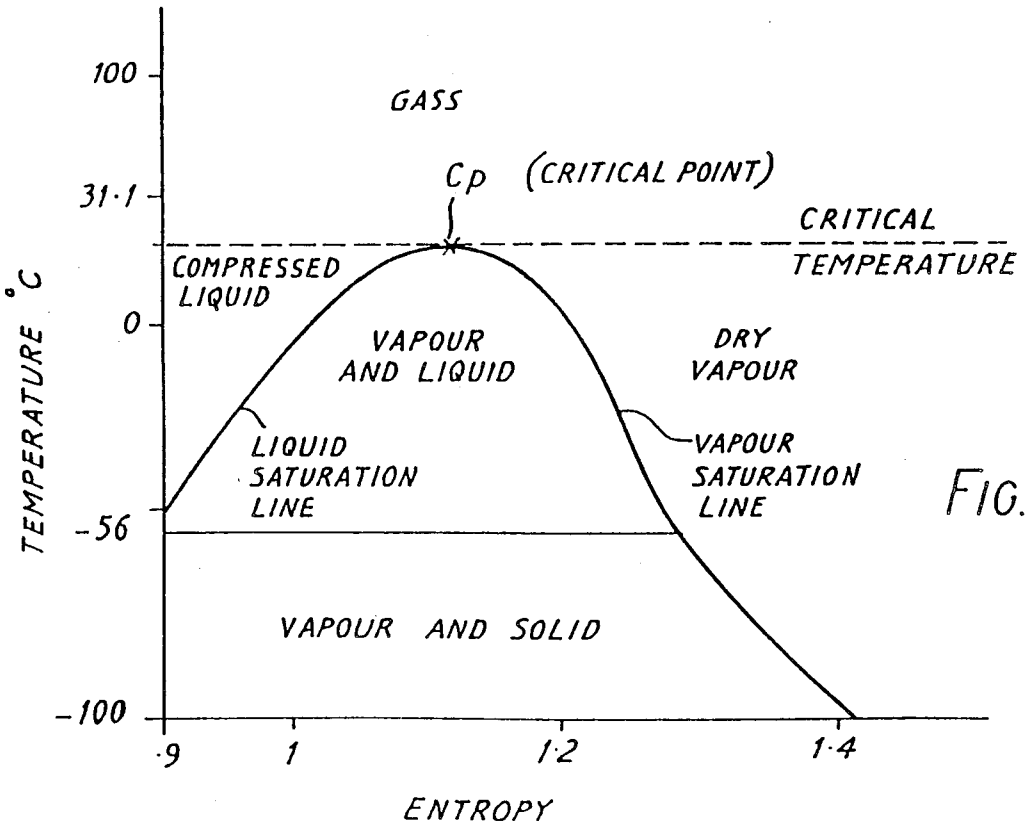
FIG. 2 is a graph of Temperature versus Entropy for Carbon Dioxide.

In FIG. 2 the curved line separating the liquid and vapour phase from the compressed liquid phase is commonly called the liquid saturation curve, and represents the range of physical states of the gas when it is at a pressure and temperature at which vapour can coexist with liquid, but the gas is all liquid with no vapour present.

In the context of filling a cylinder, it represents the states at temperatures below the critical temperature ($T_c$) (with a complementary density and pressure corresponding to each such temperature) at which the cylinder is just full of liquid, the last gas bubble having condensed.

It will be undersood that the method and apparatus described ensure that both temperature and pressure for the desired density each exceeds the temperature and pressure on the saturation line corresponding to that density, thereby doubly ensuring that the physical state of the gas in the filled cylinder is in the compressed liquid phase, and therefore that its pressure and temperature are indicative of its density.

Thus, it will be understood that, using the present invention, the desired safe density of fill can be achieved directly, without need for measurement of volumetric capacity and the necessary calculation of a safe mass to be filled, and without need of a weighing operation with its associated liability to error and demand for skilled staff.

We claim:

1. A method of filling a container of unmeasured volume with carbon dioxide to a preselected density above the criical density comprising the steps of:

(a) establishing, for the particular preselected density, that set of pressures each of which characteristically corresponds to a unique temperature higher than the saturation temperature of carbon dioxide for that desnity;

(b) registering this 1-to-1 relationship between the pressure and temperature in a suitable form to be available for reference, or for comparison with indicated pressures or indicated temperatures;

(c) supplying the carbon dioxide to the container;

(d) controllably heating the container or the carbon dioxide being supplied to the container or both to a temperature such that the contents of the container, when the preselected density has been reached, are in single phase;

(e) monitoring the temperature of the container, inferring the temperature of the carbon dioxide in the container, and identifying the registered pressure level corresponding to this temperature and to the selected density;

(f) monitoring the pressure in the container and comparing it with the registered pressure level, or successive levels, identified;

(g) discontinuing the supply of carbon dioxide as the pressure in the container attains the registered pressure level corresponding to the instantaneous temperature of the carbon dioxide in the container.

2. Carbon dixoide filling apparatus comprising (a) a reservoir of carbon dioxide;

(b) means for inducing a flow of carbon dioxide from the reservoir;

(c) valved coupling means for receiving a container to be filled and providing ON/OFF communication between the container and the means for inducing flow;

(d) container heating means for controllably heating at least one or the container or the carbon dioxide being supplied to the container to a temperature such that the contents of the container when the preselected density has been reached are in single phase;

(e) sensing means for sensing the pressure in the container;

(f) sensing means for inferring the temperature within the container;

(g) indicating means operably connected to the sensing means to indicate the pressure and temperature within the container;

(h) automatic means for comparing datum pressures and temperatures for a desired fill with the actual pressure and temperature as sensed and indicated, and wherein the said automatic means also controls the container heating means and the flow inducing means to achieve the preselected density of carbon dioxide in the container and thereafter shuts off the gas flow.

* * * * *

UNITED STATES PATENT AND TRADEMARK OFFICE

CERTIFICATE OF CORRECTION

PATENT NO. : 4,705,082

DATED : November 10, 1987

INVENTOR(S) : Hew D. Fanshawe et al

It is certified that error appears in the above-identified patent and that said Letters Patent is hereby corrected as shown below:

On the title page Insert

--(73) Assignee: Metal Box Public Limited, Company England --.

Signed and Sealed this

Twenty-fifth Day of October, 1988

*Attest:*

DONALD J. QUIGG

*Attesting Officer*

*Commissioner of Patents and Trademarks*